US010472197B2

(12) United States Patent
Hotani et al.

(10) Patent No.: US 10,472,197 B2
(45) Date of Patent: Nov. 12, 2019

(54) IMAGE FORMING APPARATUS

(71) Applicant: KYOCERA Document Solutions Inc., Osaka (JP)

(72) Inventors: Tomoya Hotani, Osaka (JP); Hiroyuki Harada, Osaka (JP); Takeshi Iketani, Osaka (JP); Akira Horie, Osaka (JP); Rei Yamagishi, Osaka (JP); Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/781,075

(22) PCT Filed: Oct. 25, 2016

(86) PCT No.: PCT/JP2016/081596
§ 371 (c)(1),
(2) Date: Jun. 1, 2018

(87) PCT Pub. No.: WO2017/094398
PCT Pub. Date: Jun. 8, 2017

(65) Prior Publication Data

US 2018/0346275 A1 Dec. 6, 2018

(30) Foreign Application Priority Data

Dec. 4, 2015 (JP) ..... 2015-237610

(51) Int. Cl.
*B65H 29/58* (2006.01)
*B65H 31/02* (2006.01)
(Continued)

(52) U.S. Cl.
CPC ..... *B65H 29/58* (2013.01); *B65H 31/02* (2013.01); *B65H 31/10* (2013.01); *B65H 31/22* (2013.01);
(Continued)

(58) Field of Classification Search
CPC ..... B65H 31/04; B65H 31/08; B65H 31/10; B65H 29/58; B65H 2301/3411; B65H 2301/341; B65H 2301/34; B65H 2301/30
(Continued)

(56) References Cited

U.S. PATENT DOCUMENTS 4,733,857 A * 3/1988 Feldeisen ..... B65H 29/00 271/184
6,135,448 A * 10/2000 Daito ..... B65H 29/12 198/433
(Continued)

FOREIGN PATENT DOCUMENTS

JP 2013-188952 A 9/2013

*Primary Examiner* — Patrick Cicchino
(74) *Attorney, Agent, or Firm* — Studebaker & Brackett PC

(57) ABSTRACT

An image forming apparatus includes a main body, a post-printing processing device, and a paper exit part. The main body forms an image on paper. The post-printing processing device is located above the main body and performs post-printing processing on paper. The paper exit part is located on a side surface of the post-printing processing device. Paper is ejected to the paper exit part. The post-printing processing device includes a paper inlet port and a conveyance device. The paper inlet port is located in a rear part of a lower surface of the post-printing processing device. The conveyance device conveys paper conveyed via the paper inlet port into the post-printing processing device in a forward direction thereof to a paper loading tray and conveys the paper therefrom leftward to eject the paper to the paper exit part located on the left side of the post-printing processing device.

8 Claims, 8 Drawing Sheets

(51) Int. Cl.

| | |
|---|---|
| ***B65H 31/10*** | (2006.01) |
| ***B65H 31/22*** | (2006.01) |
| ***B65H 31/24*** | (2006.01) |
| ***G03G 21/16*** | (2006.01) |
| ***G03G 15/00*** | (2006.01) |

(52) U.S. Cl.
CPC ..... *B65H 31/24* (2013.01); *G03G 15/6547* (2013.01); *G03G 21/1604* (2013.01); *G03G 21/1642* (2013.01); *B65H 2301/3121* (2013.01); *B65H 2301/34112* (2013.01); *B65H 2402/10* (2013.01); *B65H 2402/45* (2013.01); *B65H 2405/332* (2013.01); *B65H 2405/3311* (2013.01); *B65H 2408/111* (2013.01); *B65H 2801/27* (2013.01); *G03G 2221/1696* (2013.01)

(58) Field of Classification Search
USPC ..... 271/225, 184, 185
See application file for complete search history.

(56) References Cited

U.S. PATENT DOCUMENTS

| | | | | |
|---|---|---|---|---|
| 6,422,553 | B1 * | 7/2002 | Asao | B65H 31/24 270/58.11 |
| 6,511,063 | B1 * | 1/2003 | Dickhoff | B42C 1/12 271/184 |
| 8,934,807 | B2 | 1/2015 | Takahashi | |
| 9,086,680 | B2 | 7/2015 | Takahashi | |
| 9,238,562 | B2 * | 1/2016 | Mori | B65H 15/00 |
| 9,708,141 | B2 * | 7/2017 | Kishi | B65H 29/52 |
| 2013/0136484 | A1 | 5/2013 | Takahashi | |
| 2013/0136485 | A1 | 5/2013 | Takahashi | |
| 2015/0050060 | A1 * | 2/2015 | Kim | B65H 31/02 399/407 |
| 2015/0055200 | A1 * | 2/2015 | Hama | H04N 1/00 358/498 |
| 2017/0183186 | A1 * | 6/2017 | Hara | B65H 31/18 |

* cited by examiner

IMAGE FORMING APPARATUS

TECHNICAL FIELD

The present invention relates to an image forming apparatus.

BACKGROUND ART

An image forming apparatus employing a backside C-shaped path system or an S-shaped path system includes a first paper exit tray and a first paper exit port. The first paper exit tray is located at an upper surface of the image forming apparatus. The first paper exit port is formed in an inner side surface behind the first paper exit tray. Paper on which an image has been formed is ejected onto the first paper exit tray from the first paper exit port (Patent Literature 1).

In a configuration in which a post-printing processing device (for example, a stapling device) is added to such an image forming apparatus, the image forming apparatus has a second paper exit port. The second paper exit port is located in a rear part of the upper surface of the image forming apparatus. The post-printing processing device is located above the image forming apparatus. The post-printing processing device includes a paper inlet port, a third paper exit port, and a second paper exit tray. The paper inlet port is formed in a rear part of a lower surface of the post-printing processing device (i.e., at a position corresponding to the second paper exit port). The third paper exit port and the second paper exit tray are located at the front of the post-printing processing device.

The post-printing processing device conveys paper ejected from the second paper exit port into the post-printing processing device via the paper inlet port. The post-printing processing device then conveys the paper forward. After post-printing processing, the post-printing processing device further conveys the paper forward to eject the paper to the outside from the third paper exit port. As a result, the paper subjected to the post-printing processing is ejected onto the second paper exit tray.

An in-body space from which paper ejected onto the first paper exit tray is taken out is defined between the image forming apparatus and the post-printing processing device. An opening to the in-body space is located at the front of the image forming apparatus.

CITATION LIST

Patent Literature

[Patent Literature 1] Japanese Patent Application Laid-Open Publication No. 2013-188952

SUMMARY OF INVENTION

Technical Problem

However, the opening to the in-body space is located below the second paper exit tray. Therefore, when a capacity of the second paper exit tray is increased, the second paper exit tray is provided above the post-printing processing device in order to prevent the opening to the in-body space from being blocked. The above results in an increase in entire height of the image forming apparatus.

The present invention was made in view of the above problem. It is an object of the present invention to provide an image forming apparatus including a main body and a post-printing processing device located above the main body. An increase in entire height of the image forming apparatus is not involved even when a capacity of a paper exit part thereof to which paper subjected to post-printing processing is ejected is increased.

Solution to Problem

An image forming apparatus according to the present invention includes a main body, a post-printing processing device, and a paper exit part. The main body forms an image on paper. The post-printing processing device is located above the main body and performs post-printing processing on the paper. The paper exit part is located on a side surface of the post-printing processing device. The paper is ejected to the paper exit part. The post-printing processing device includes a paper inlet port and a conveyance device. The paper inlet port is located in a rear part of a lower surface of the post-printing processing device. The conveyance device conveys paper conveyed via the paper inlet port into the post-printing processing device to a first position in a forward direction of the post-printing processing device and conveys the paper from the first position in a transverse direction perpendicular to the forward direction to eject the paper to the paper exit part.

Advantageous Effects of Invention

According to the present invention, an increase in entire height of the image forming apparatus is not involved even when a capacity of the paper exit part thereof to which paper subjected to post-printing processing is ejected is increased.

DESCRIPTION OF EMBODIMENTS

Figure 1:
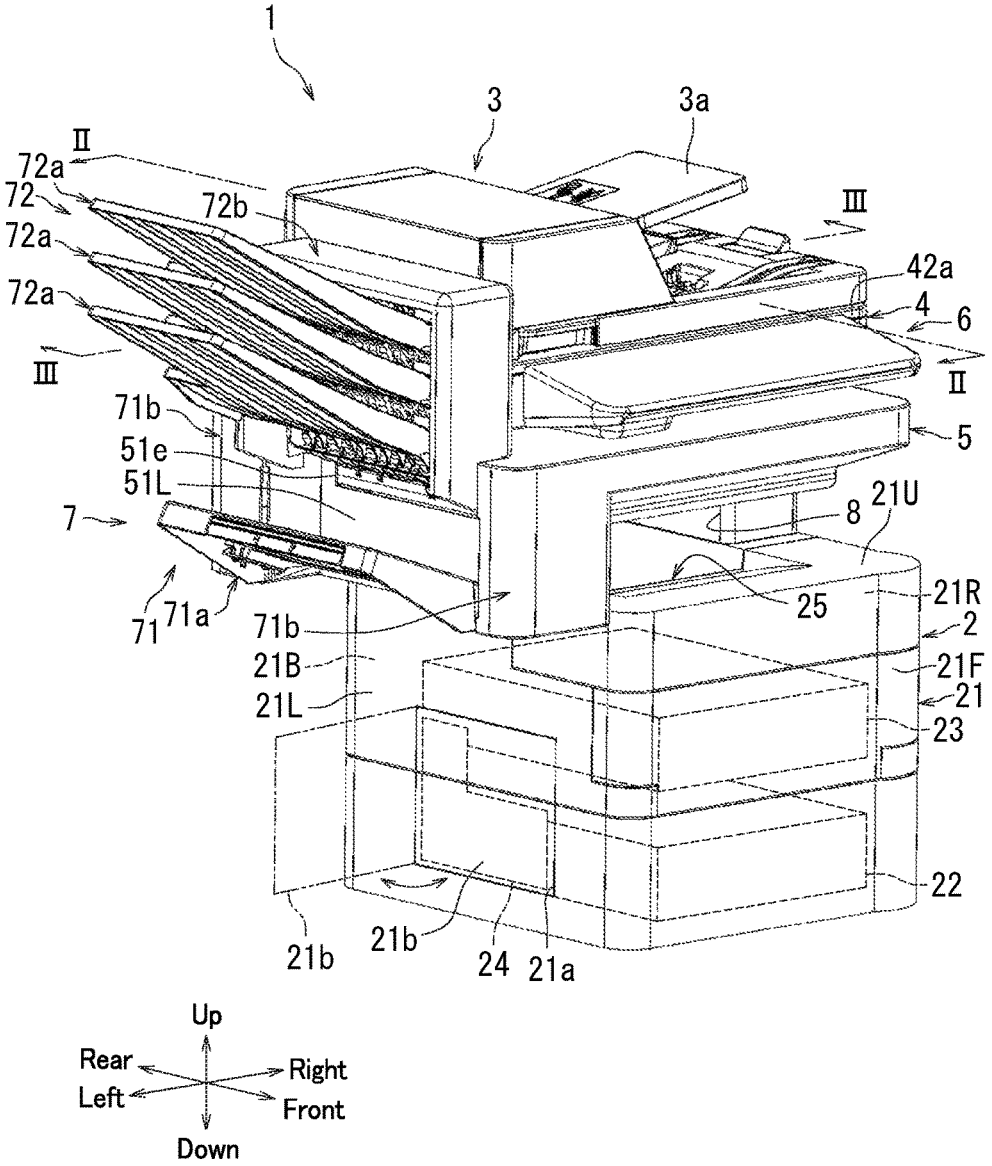
FIG. 1 is a perspective view of an image forming apparatus according to the present embodiment.

The following describes embodiments of the present invention with reference to the drawings. In the drawings, elements that are the same or equivalent are labelled using the same reference signs, and explanation thereof is not repeated.

Figure 2:
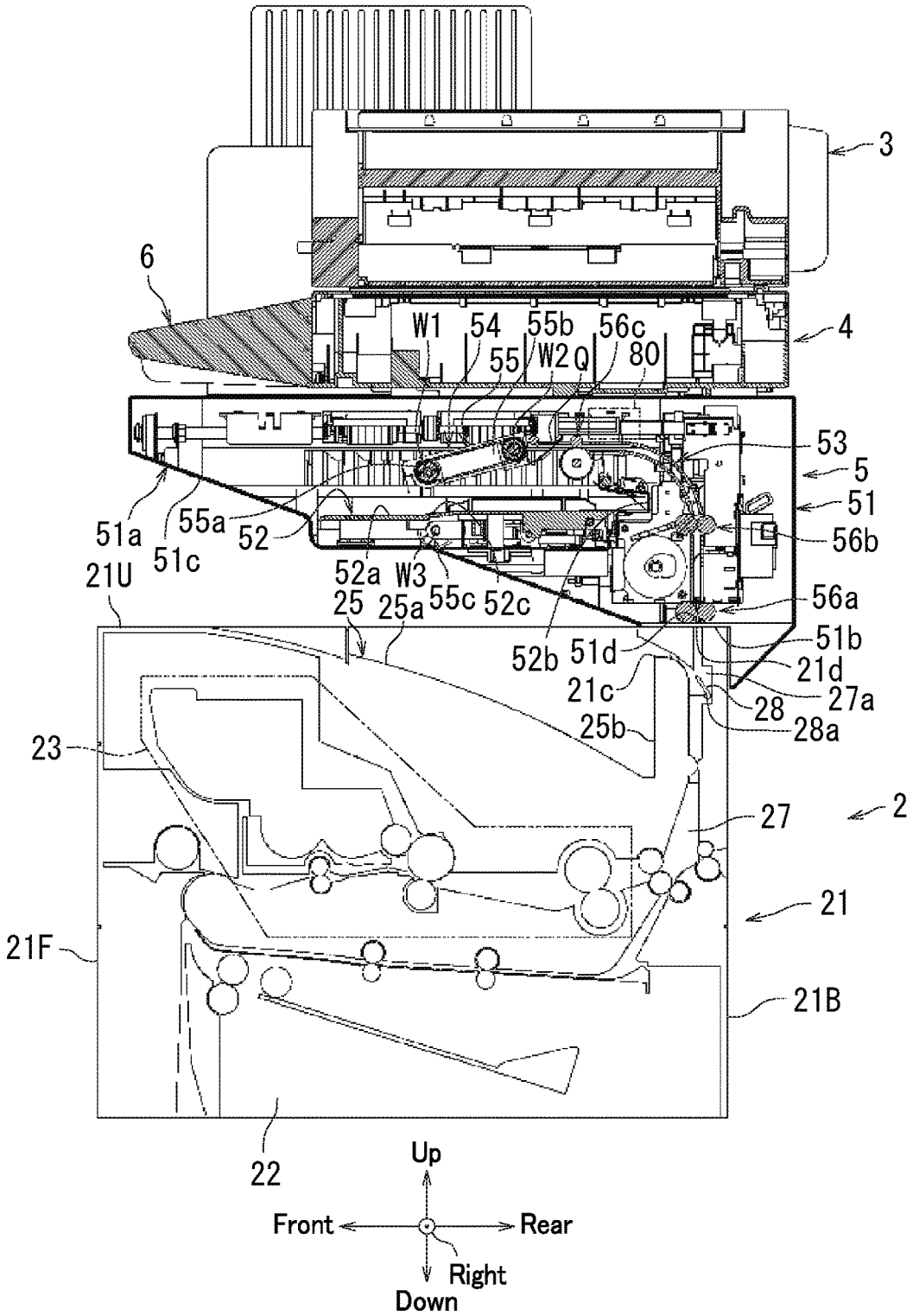
FIG. 2 is a cross-sectional view taken along a line II-II in FIG. 1.
Figure 3:
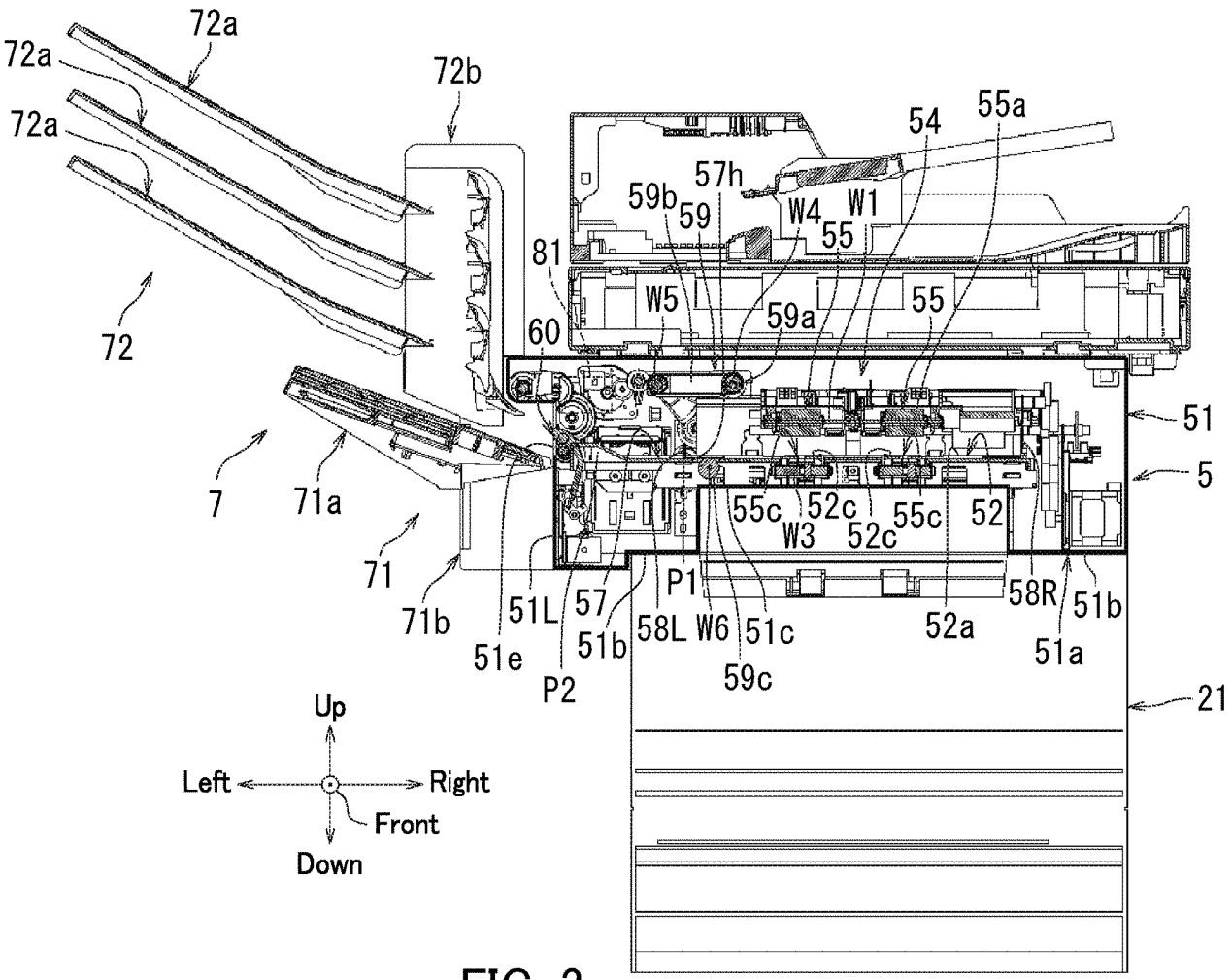
FIG. 3 is a cross-sectional view taken along a line in FIG. 1.

The following describes an image forming apparatus according to the present embodiment with reference to FIGS. 1 to 3. FIG. 1 is a perspective view of the image forming apparatus according to the present embodiment.

As illustrated in FIG. 1, an image forming apparatus 1 according to the present embodiment includes a main body 2, an automatic document feeder 3, an image reading device 4, a post-printing processing device 5, an operation panel 6, and a paper exit part 7. An in-body space 8 is defined between the main body 2 and the post-printing processing device 5. The in-body space 8 is open at the front of the image forming apparatus 1.

For convenience of explanation, a side of the image forming apparatus 1 on which the operation panel 6 is located is defined as a front side of the image forming apparatus 1 and the opposite side thereof is defined as a rear side of the image forming apparatus 1. Further, one of opposite sides of the image forming apparatus 1 in a horizontal direction perpendicular to the front-rear direction of the image forming apparatus 1 is defined as a right side of the image forming apparatus 1 and the other side is defined as a left side of the image forming apparatus 1.

The operation panel 6 is operated by a user. The user can instruct the image forming apparatus 1 to perform various functions through operations on the operation panel 6. The operation panel 6 is located on a front surface 42*a* of the image reading device 4.

The automatic document feeder 3 includes a document loading tray 3*a*. The automatic document feeder 3 is located above the image reading device 4. Plural sheets of a document are to be stacked on the document loading tray 3*a*. The automatic document feeder 3 feeds the document sheet by sheet from the document loading tray 3*a* to the image reading device 4 in response to a user operation on the operation panel 6.

The image reading device 4 reads an image from a document and generates image data on the basis of the read image. The document is a document fed to the image reading device 4 by the automatic document feeder 3 or a document placed on the image reading device 4 by the user. The image reading device 4 is located above the post-printing processing device 5.

The main body 2 forms an image on paper on the basis of image data. The image data is for example image data generated by the image reading device 4. The main body 2 includes a housing 21, a paper feed cassette 22, an image forming device 23, a waste toner bottle 24, and an in-body paper exit tray 25.

The housing 21 accommodates the paper feed cassette 22, the image forming device 23, and the waste toner bottle 24. Specifically, the paper feed cassette 22 is located in a lower part within the housing 21. The image forming device 23 is located above the paper feed cassette 22. The waste toner bottle 24 is located on the left side of the paper feed cassette 22.

The paper teed cassette 22 feeds paper to the image forming device 23. Plural sheets of the paper are stacked in the paper feed cassette 22. The image forming device 23 forms an image indicated by image data on the paper with toner. The waste toner bottle 24 accommodates waste toner that is a waste product of image formation on the paper by the image forming device 23.

The housing 21 has a substantially rectangular parallelepiped box-like shape. The housing 21 has a front surface 21F, a rear surface 21B, a left side surface 21L, a right side surface 21R, and an upper surface 21U. Also, the housing 21 includes an opening 21*a* and an openable and closeable cover 21*b*. The opening 21*a* and the openable and closeable cover 21*b* are located in the left side surface 21L of the housing 21.

The opening 21*a* is an opening from which the waste toner bottle 24 is taken out of the housing 21. The opening 21*a* is rectangular in shape, for example. The openable and closeable cover 21*b* opens or closes the opening 21*a*. The openable and closeable cover 21*b* is rectangular in shape, for example. One of side edges of the openable and closeable cover 21*b* is turnably connected to an edge of the opening 21*a*.

The in-body paper exit tray 25 is located at the upper surface 21U of the housing 21.

The post-printing processing device 5 performs post-printing processing on paper on which an image has been formed by the main body 2. The post-printing processing in the present embodiment is punching processing or stapling processing. The punching processing is processing of punching a hole in paper. The stapling processing is processing of binding plural sheets of paper with a stapler. The post-priming processing device 5 is located above the main body 2.

The post-printing processing device 5 has a left side surface 51L. The left side surface 51L has a paper exit port 51*e*. The post-printing processing device 5 ejects paper subjected to the post-printing processing from the paper exit port 51*e* to the paper exit part 7.

Paper subjected to the post-printing processing by the post-printing processing device 5 is ejected to the paper exit part 7. The paper exit pail 7 is located on the left side surface 51L of the post-printing processing device 5.

The paper exit part 7 includes a movable paper exit tray unit 71 and a sorting tray unit 72.

Paper ejected from the paper exit port 51*e* of the post-printing processing device 5 is stacked on the movable paper exit tray unit 71. The movable paper exit tray unit 71 is located on the left side surface 51L of the post-printing processing device 5.

The movable paper exit tray unit 71 includes a movable paper exit tray 71*a* and paired supports 71*b*.

The paired supports 71*b* support opposite ends of the movable paper exit tray 71*a* in a manner that the movable paper exit tray 71*a* is movable in the up-down direction. The paired supports 71*b* are located on respective opposite sides of the paper exit port 51*e* on the left side surface 51L of the post-printing processing device 5. The movable paper exit tray 71*a* is located below the paper exit port 51*e* of the post-printing processing device 5 and movable downward below the paper exit port 51*e*.

Paper ejected from the paper exit port 51*e* of the post-printing processing device 5 is stacked on the sorting tray unit 72. The sorting tray unit 72 is located on the left side surface 51L of the post-printing processing device 5 and above the movable paper exit tray unit 71.

The sorting tray unit 72 includes a plurality of sorting trays 72*a* and a support 72*b*.

The support 72*b* supports the plurality of sorting trays 72*a*. The support 72*b* is located on the left side surface 51L of the post-printing processing device 5 and above the paper exit port 51*e*. The support 72*b* extends upward from the post-printing processing device 5. The plurality of sorting trays 72*a* are arranged in the up-down direction.

FIG. 2 is a cross-sectional view taken along a line II-II in FIG. 1.

As illustrated in FIG. 2, the in-body paper exit tray 25 is a recess in the upper surface 21U of the housing 21. The in-body paper exit tray 25 has a bottom surface 25*a* and a rear inner surface 25*b*. The bottom surface 25*a* slopes downward in a direction from the front side toward the rear side thereof. The rear inner surface 25*b* stands upward from a rear end of the bottom surface 25*a*.

The housing 21 of the main body 2 further has a first paper exit port 21*c* and a second paper exit port 21*d*.

The first paper exit port 21*c* is an opening from which paper on which an image has been formed by the image forming device 23 is ejected onto the in-body paper exit tray 25. The first paper exit port 21*c* is located in an upper part of the rear inner surface 25*b* of the in-body paper exit tray 25.

The second paper exit port 21*d* is an opening through which paper on which an image has been formed by the image forming device 23 is conveyed to the post-printing processing device 5. The second paper exit port 21*d* is located in a rear part of the upper surface 21U of the housing 21.

The main body 2 further includes a paper conveyance path 27 and a switch guide 28.

The paper conveyance path 27 is a conveyance path along which paper is conveyed from the paper feed cassette 22 to the first paper exit port 21*c* or the second paper exit port 21*d*. The paper conveyance path 27 is a conveyance path of an S-shaped path system, for example. That is, the paper conveyance path 27 reverses from the front side of the paper feed cassette 22 toward the rear side thereof and extends substantially horizontally toward the rear side of the paper feed cassette 22. The paper conveyance path 27 then extends upward along the rear surface 21B of the housing 21 and diverges into two paths at a divergence point 27*a*. One of the two paths leads to the first paper exit port 21*c* and the other leads to the second paper exit port 21*d*.

The switch guide 28 switches a conveyance direction of paper toward the first paper exit port 21*c* or the second paper exit port 21*d*. The switch guide 28 is located at the divergence point 27*a*. The switch guide 28 is pivotable about a pivot axis 28*a*. The pivot axis 28*a* extends in the left-right direction of the housing 21.

The post-printing processing device 5 includes a housing 51, a paper loading tray 52, a first conveyance path 53, a conveyance device 54, and a punching device 80. The conveyance device 54 includes a first conveyance roller unit 55 and a plurality of conveyance roller pairs 56*a*, 56*b*, and 56*c*. The punching device 80 is an example of a post-printing processing section.

The housing 51 accommodates the paper loading tray 52, the first conveyance path 53, the conveyance device 54, and the punching device 80. The housing 51 has a substantially trapezoidal box-like shape. The housing 51 has a lower surface 51*a*. The lower surface 51*a* includes a connection surface 51*b* and a sloped surface 51*c* adjacent to the connection surface 51*b*.

Specifically, the connection surface 51*b* constitutes a rear part of the lower surface 51*a*. The connection surface 51*b* is in contact with the rear part of the upper surface 211 of the main body 2. The sloped surface 51*c* constitutes a middle part and a front part of the lower surface 51*a*. The sloped surface 51*c* slopes upward in a direction toward the front side. A space between the sloped surface 51*c* and the in-body paper exit tray 25 is the in-body space 8 described with reference to FIG. 1.

The housing 51 has a paper inlet port 51*d*. The paper inlet port 51*d* is an opening through which paper is conveyed from the second paper exit port 21*d* of the main body 2 into the post-printing processing device 5. The paper inlet port 51*d* is located in the connection surface 51*b*.

Paper is stacked on the paper loading tray 52. The paper loading tray 52 is arranged horizontally in a central part of the inside of the housing 51. The paper loading tray 52 includes a tray main body 52*a* and a stopper 52*b*. The tray main body 52*a* has a flat plate-like shape. The stopper 52*b* aligns trailing edges of plural sheets of paper stacked on the tray main body 52*a*. The stopper 52*b* stands upward at a rear end of the tray main body 52*a*.

The first conveyance path 53 is a conveyance path along which paper is conveyed from the paper inlet port 51*d* to the paper loading tray 52. The first conveyance path 53 extends upward from the paper inlet port 51*d* and curves forward from behind the paper loading tray 52. The first conveyance path 53 then extends forward above the paper loading tray 52 to a position Q above the paper loading tray 52. The position Q is located above the center of the paper loading tray 52 in the front-rear direction with a given distance therebetween.

The plurality of conveyance roller pairs 56*a*, 56*b*, and 56*c* are located along the first conveyance path 53. The plurality of conveyance roller pairs 56*a*. 56*b*, and 56*c* convey paper from the paper inlet port 51*d* to the paper loading tray 52 along the first conveyance path 53.

The first conveyance roller unit 55 causes paper stacked on the tray main body 52*a* to move rearward to the stopper 52*b*. As a result, trailing edges of plural sheets of paper stacked on the tray main body 52*a* are aligned by the stopper 52*b*. The first conveyance roller unit 55 is located in the vicinity of the paper loading tray 52.

The first conveyance roller unit 55 includes a first upper conveyance roller 55*a*, a first lower conveyance roller 55*c*, and a support 55*b*.

The first lower conveyance roller 55*c* is located at the paper loading tray 52. Specifically, the tray main body 52*a* has an opening 52*c*. The first lower conveyance roller 55*c* is located below the opening 52*c* of the tray main body 52*a*. The first lower conveyance roller 55*c* is rotatable about a rotation axis W3. The rotation axis W3 extends in the left-right direction of the post-printing processing device 5. An upper part of the first lower conveyance roller 55*c* projects upward from the tray main body 52*a* through the opening 52*c* thereof.

The support 55*b* supports the first upper conveyance roller 55*a*. The first upper conveyance roller 55*a* is located at a front end of the support 55*b* and rotatable about a rotation axis W1. A rear end of the support 55*b* is located above a central part of the paper loading tray 52 and turnable about a turn axis W2. The rotation axis W1 and the turn axis W2 extend in the left-right direction of the post-printing processing device 5. For example, the first upper conveyance roller 55*a* is rotationally driven. The first lower conveyance roller 55*c* passively rotates along with movement of paper.

The first upper conveyance roller 55*a* is located above the first lower conveyance roller 55*c*. As a result of turn of the support 55*b* in a positive direction about the turn axis W2, the first upper conveyance roller 55*a* comes into contact with an upper surface of paper (not illustrated) conveyed to the tray main body 52*a*. When paper is conveyed from the first conveyance path 53 to the tray main body 52*a* via the underside of the first upper conveyance roller 55*a*, the support 55*b* turns in the positive direction about the turn axis W2. The paper is moved rearward to the stopper 52*b* by rotation of the first upper conveyance roller 55*a*. As a result, trailing edges of plural sheets of paper stacked on the tray main body 52*a* are aligned by the stopper 52*b*. When the trailing edges of the paper are aligned by the stopper 52*b*, the support 55*b* turns in a reverse direction about the turn axis W2 and the first upper conveyance roller 55*a* returns to a position above the paper loading tray 52.

The punching device 80 punches a hole in paper. The punching device 80 is located in the vicinity of the first conveyance path 53. In response to a user operation on the operation panel 6, the punching device 80 punches a hole in paper passing through a specific part of the first conveyance path 53.

FIG. 3 is a cross-sectional view taken along a line III-III in FIG. 1.

As illustrated in FIG. 3, the post-printing processing device 5 includes two first conveyance roller units 55. The two first conveyance roller units 55 are arranged side by side in the left-right direction of the post-printing processing device 5. Further, the housing 51 has two connection surfaces 51*b*. The two connection surfaces 51*b* are respectively connected to a left part and a right part of the upper surface 21U of the main body 2 described with reference to FIG. 1.

The post-printing processing device 5 further includes a second conveyance path 57, paired movable guides 58L and 58R (a first movable guide and a second movable guide), and a stapling device 81. Furthermore, the housing 51 has the left side surface 51L and the paper exit port 51*e*. The stapling device 81 is an example of the post-printing processing section.

The paper exit port 51*e* is an opening through which paper is ejected from the post-printing processing device 5 to the paper exit part 7. The paper exit port 51*e* is located in the left side surface 511, of the housing 51.

The second conveyance path 57 is a conveyance path along which paper is conveyed from the paper loading tray 52 to the paper exit port 51*e*. The paper is conveyed in a manner to slide on an upper surface of the second conveyance path 57. The second conveyance path 57 extends in the left-right direction (transverse direction) of the post-printing processing device 5. Accordingly, the second conveyance path 57 is perpendicular to the first conveyance path 53.

The paired movable guides 58L and 58R convey paper stacked on the paper loading tray 52 from a position P1 (first position) to a position P2 (second position) along the second conveyance path 57. The position P1 is located at a left end of the paper loading tray 52. The position P2 is located between the position P1 and the paper exit port 51*e* (i.e., between the position P1 and the paper exit part 7).

The paired movable guides 58L and 58R are respectively located on the left side and the right side of the paper loading tray 52. Paper conveyed from the first conveyance path 53 to the paper loading tray 52 is interposed between the paired movable guides 58L and 58R. The paired movable guides 58L and 58R align left and right edges of plural sheets of paper stacked on the paper loading tray 52.

The paired movable guides 58L and 58R move along the second conveyance path 57 in such a manner that a distance therebetween is kept constant.

The stapling device 81 binds plural sheets of paper stacked on the paper loading tray 52 with a stapler. The stapling device 81 is located in the vicinity of the second conveyance path 57. When plural sheets of paper are conveyed to the position P2 by the paired movable guides 58L and 58R, the stapling device 81 hinds the plural sheets of paper with the stapler in response to a user operation on the operation panel 6.

The conveyance device 54 further includes a second conveyance roller unit 59 and a conveyance roller pair 60.

The second conveyance roller unit 59 conveys paper from the position P2 to the paper exit port 51*e*. The second conveyance roller unit 59 is located in the vicinity of the second conveyance path 57. The conveyance roller pair 60 ejects the paper from the paper exit port 51*e* to the paper exit part 7. The conveyance roller pair 60 is located in the vicinity of the paper exit port 51*e*.

The second conveyance roller unit 59 includes a second upper conveyance roller 59*a*, a second lower conveyance roller 59*c*, and a support 59*b*.

Specifically, the second lower conveyance roller 59*c* is located on the second conveyance path 57. The second conveyance path 57 has an opening 57*h*. The second lower conveyance roller 59*c* is located below the opening 57*h* of the second conveyance path 57 and rotatable about a rotation axis W6. The rotation axis W6 extends in the front-rear direction of the post-printing processing device 5. An upper part of the second lower conveyance roller 59*c* projects upward from the second conveyance path 57 through the opening 57*h* thereof.

The support 59*b* supports the second upper conveyance roller 59*a*. The second upper conveyance roller 59*a* is located at a front end of the support 59*b* and rotatable about a rotation axis W4. A rear end of the support 59*b* is located above the second conveyance path 57 and turnable about a turn axis W5. The rotation axis W4 and the turn axis W5 extend in the front-rear direction of the post-printing processing device 5. For example, the second upper conveyance roller 59*a* is rotationally driven. The second lower conveyance roller 59*c* passively rotates along with movement of paper.

The second upper conveyance roller 59*a* is located above the second lower conveyance roller 59*c*. The paired movable guides 58L and 58R convey paper (not illustrated) in a manner that a left edge of the paper moves from the position P1 to the position P2. Thereafter, the support 59*b* turns in a positive direction about the turn axis W5 and the second upper conveyance roller 59*a* comes into contact with an upper surface of the paper. The paper is then conveyed along the second conveyance path 57 from the position P2 to the paper exit port 51*e* by rotation of the second upper conveyance roller 59*a*. Upon completion of conveyance of the paper by the second upper conveyance roller 59*a*, the support 59*b* turns in a reverse direction about the turn axis W5 and the second upper conveyance roller 59*a* returns to an upper position.

Figure 4:
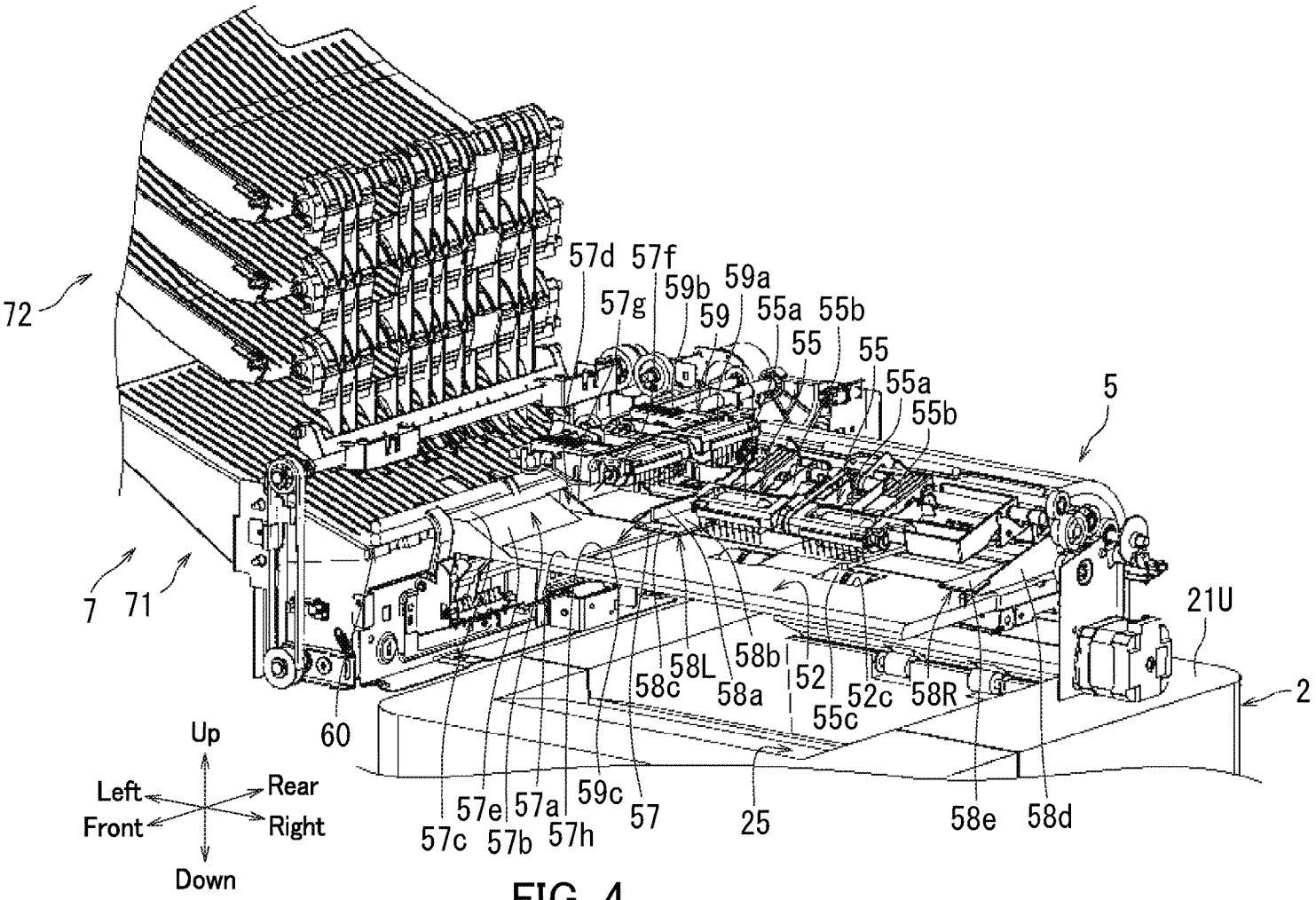
FIG. 4 is a perspective view illustrating the inside of a post-printing processing device and the inside of a paper exit part.
Figure 5:
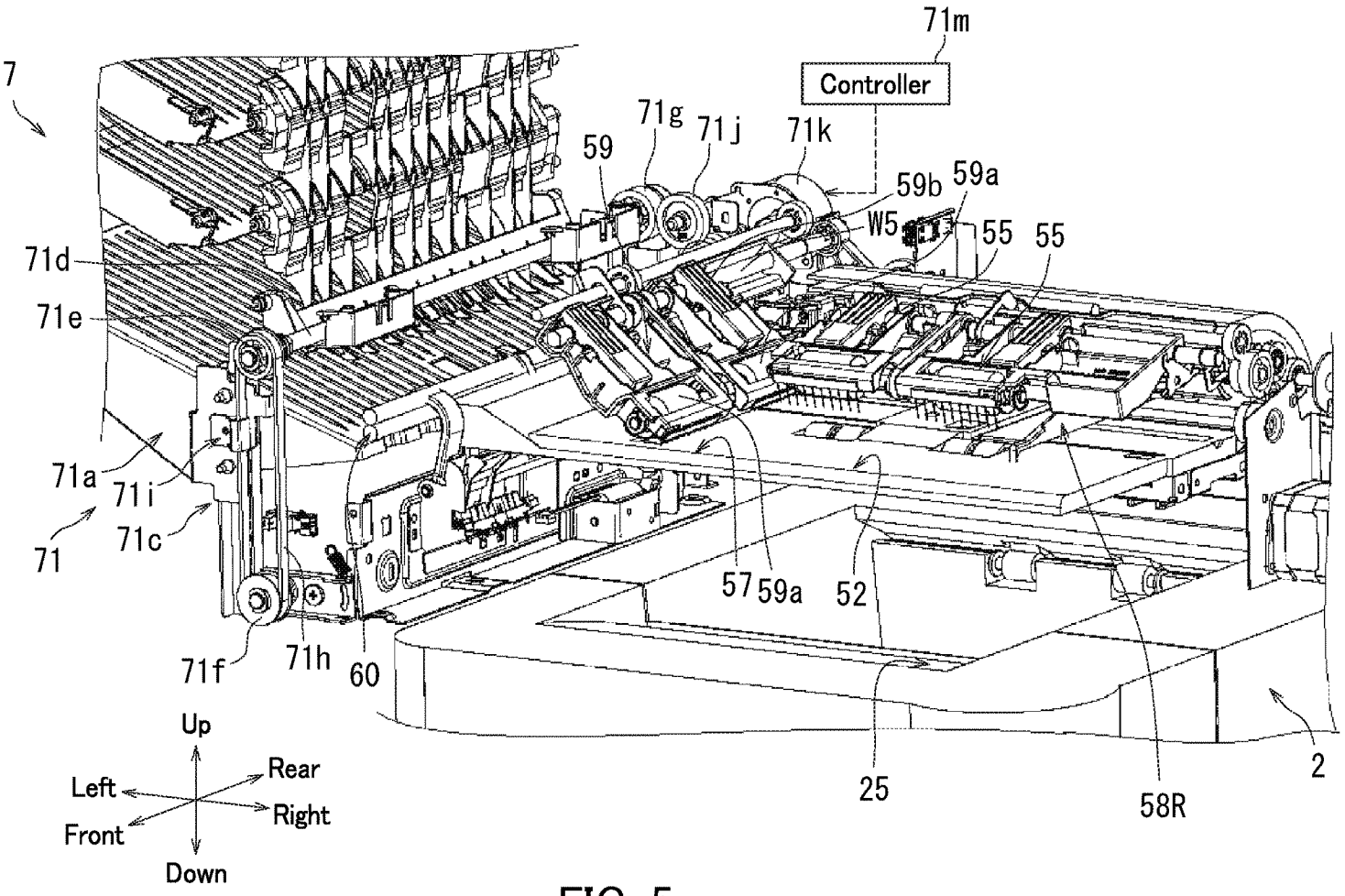
FIG. 5 is another perspective view illustrating the inside of the post-printing processing device and the inside of the paper exit part.

The following describes the paired movable guides 58L and 58R and the second conveyance path 57 in detail with reference to FIGS. 4 and 5. FIG. 4 is a perspective view illustrating the inside of the post-printing processing device 5 and the inside of the paper exit part 7. FIG. 5 is another perspective view illustrating the inside of the post-printing processing device 5 and the inside of the paper exit part 7.

As illustrated in FIG. 4, the movable guide 58L includes a guide main body 58*a*, a horizontal plate 58*b*, and a slit 58*c*. One of the paired movable guides 58L and 58R that is located beside the paper exit part 7 is the movable guide 58L.

The horizontal plate 58*b* is located under paper stacked on the paper loading tray 52. The horizontal plate 58*b* is a flat rectangular plate. The guide main body 58*a* has a rectangular plate-like shape and stands on a left end of the horizontal plate 58*b*. The slit 58*c* extends in the guide main body 58*a* and the horizontal plate 58*b*. Specifically, the slit 58*c* extends over the entire height of the guide main body 58*a* in the up-down direction. Also, the slit 58*c* extends from the left end to the center of the horizontal plate 58*b* in the left-right direction. A plurality of the slits 58*c* are provided in the front-rear direction of the movable guide 58L so as to be spaced from one another.

The movable guide 58R includes a guide main body 58*d* and a horizontal plate 58*e*.

The horizontal plate 58*e* is located under paper stacked on the paper loading tray 52. The horizontal plate 58*e* is a flat rectangular plate. The guide main body 58*a* has a triangular plate-like shape and stands on a right end of the horizontal plate 58*e*.

The second conveyance path 57 includes a first flat path 57*a*, a step 57*b*, a second flat path 57*c*, and a guide plate 57*d*.

The step 57*b* is located between the first flat path 57*a* and the second flat path 57*c*. The width of the step 57*b* in the up-down direction is the same as that of the guide main body 58*a* of the movable guide 58L in the up-down direction. The first flat path 57*a* is a flat path connecting the left end of the paper loading tray 52 and a lower end of the step 57*b*. The second flat path 57*c* is a flat path connecting an upper end of the step 57*b* and the paper exit port 51*e* described with reference to FIG. 1. The step 57*b* has a sloped surface 57*e* on the front side thereof and a vertical surface 57*f* on the rear side thereof. The sloped surface 57*e* slopes downward toward the right of the post-printing processing device 5 (i.e., in a direction from the position P2 toward the position P1 described with reference to FIG. 3). The vertical surface 57*f* is perpendicular to the first flat path 57*a* and extends in the front-rear direction of the post-printing processing device 5.

The guide plate 57*d* is a triangular plate. The guide plate 57*d* is located at a corner between the vertical surface 57*f* and the first flat path 57*a* and perpendicular to the vertical surface 57*f* and the first flat path 57*a*. Note that the guide plate 57*d* extends in the up-down direction and rightward.

The guide plate 57*d* has an upper edge 57*g*. The upper edge 57*g* slopes at the same angle as the sloped surface 57*e*. A plurality of the guide plates 57*d* are provided along the vertical surface 57*f* so as to be spaced from one another. The plurality of the guide plates 57*d* each correspond to one of the plurality of the slits 58*c* of the movable guide 58L.

When the paired movable guides 58L and 58R move to convey paper (not illustrated) from the position P1 to the position P2 (i.e., to the position of the vertical surface 57*f*), the movable guide 58L comes into contact with the vertical surface 57*f*. Further, in the course of the above movement, the guide plates 57*d* are inserted into the respective slits 58*c* of the movable guide 58L. In the course of conveyance of the paper to the position of the vertical surface 57*f* (i.e., to the position P2) by the paired movable guides 58L and 58R, a left end of the paper (an end close to the paper exit part 7) moves upward along respective upper edges 57*g* of the guide plates 57*d* and reaches an upper end of the movable guide 58L. In other words, the left end of the paper is lifted to the upper end of the movable guide 58L by the guide plates 57*d*. As a result, the paper is conveyed over the movable guide 58L (i.e., over the step 57*b*) to the second flat path 57*c*. Thus, the paper can be conveyed over the movable guide 58L with a simple configuration according to the present embodiment.

When the support 59*b* of the second conveyance roller unit 59 turns in the positive direction about the turn axis W5 as illustrated in FIG. 5, the second upper conveyance roller 59*a* comes into contact with an upper surface of paper (not illustrated). The paper is then conveyed from the position P2 to the conveyance roller pair 60 by rotation of the second upper conveyance roller 59*a*. The paper is then conveyed to the paper exit part 7 via the paper exit port 51*e* described with reference to FIG. 1 by rotation of the conveyance roller pair 60. Thereafter, the support 59*b* turns in the reverse direction about the turn axis W5 and the second upper conveyance roller 59*a* returns to a position above the second lower conveyance roller 59*c*.

The following describes the movable paper exit tray unit 71 in detail with reference to FIG. 5.

As illustrated in FIG. 5, the movable paper exit tray unit 71 further includes a driving mechanism 71*c*. The driving mechanism 71*c* includes a rotary shaft 71*d*, a first pulley 71*e*, a second pulley 71*f*, a drive gear 71*g*, an endless belt 71*h*, a coupling piece 71*i*, an intermediate gear 71*j*, a driving section 71*k*, and a controller 71*m*.

The rotary shaft 71*d* extends between the paired supports 71*b* described with reference to FIG. 1. The first pulley 71*e* is fixed to a front end of the rotary shaft 71*d*. The first pulley 71*e*, the second pulley 71*f*, the endless belt 71*h*, and the coupling piece 71*i* are accommodated in one of the paired supports 71*b* that is located on the front side. The second pulley 71*f* is rotatably supported at a position downwardly spaced from the first pulley 71*e*. The endless belt 71*h* is stretched between the first pulley 71*e* and the second pulley 71*f*. The coupling piece 71*i* couples the endless belt 71*h* and the movable paper exit tray 71*a*. Similarly, two pulleys 71*e* and 71*f*, an endless belt 71*h*, and a coupling piece 71*i* are accommodated in the other one of the paired supports 71*b* that is located on the rear side.

The driving section 71*k* is for example a motor. The driving section 71*k* rotationally drives the drive gear 71*g* in a positive direction or in a reverse direction via the intermediate gear 71*j*. The drive gear 71*g* is fixed to the rotary shaft 71*d* and causes the rotary shaft 71*d* to rotate in the positive direction or in the reverse direction.

When the rotary shaft 71*d* rotates in the positive direction, the endless belt 71*h* circulates in the positive direction and the movable paper exit tray 71*a* moves downward. When the rotary shaft 71*d* rotates in the reverse direction, the endless belt 71*h* circulates in the reverse direction and the movable paper exit tray 71*a* moves upward.

The controller 71*m* controls the driving section 71*k* in a manner that the movable paper exit tray 71*a* moves upward or downward according to the number of sheets of paper stacked on the movable paper exit tray 71*a*. Specifically, the controller 71*m* controls the driving section 71*k* in a manner that the movable paper exit tray 71*a* moves downward as the number of sheets of paper stacked on the movable paper exit tray 71*a* increases.

Figure 6:
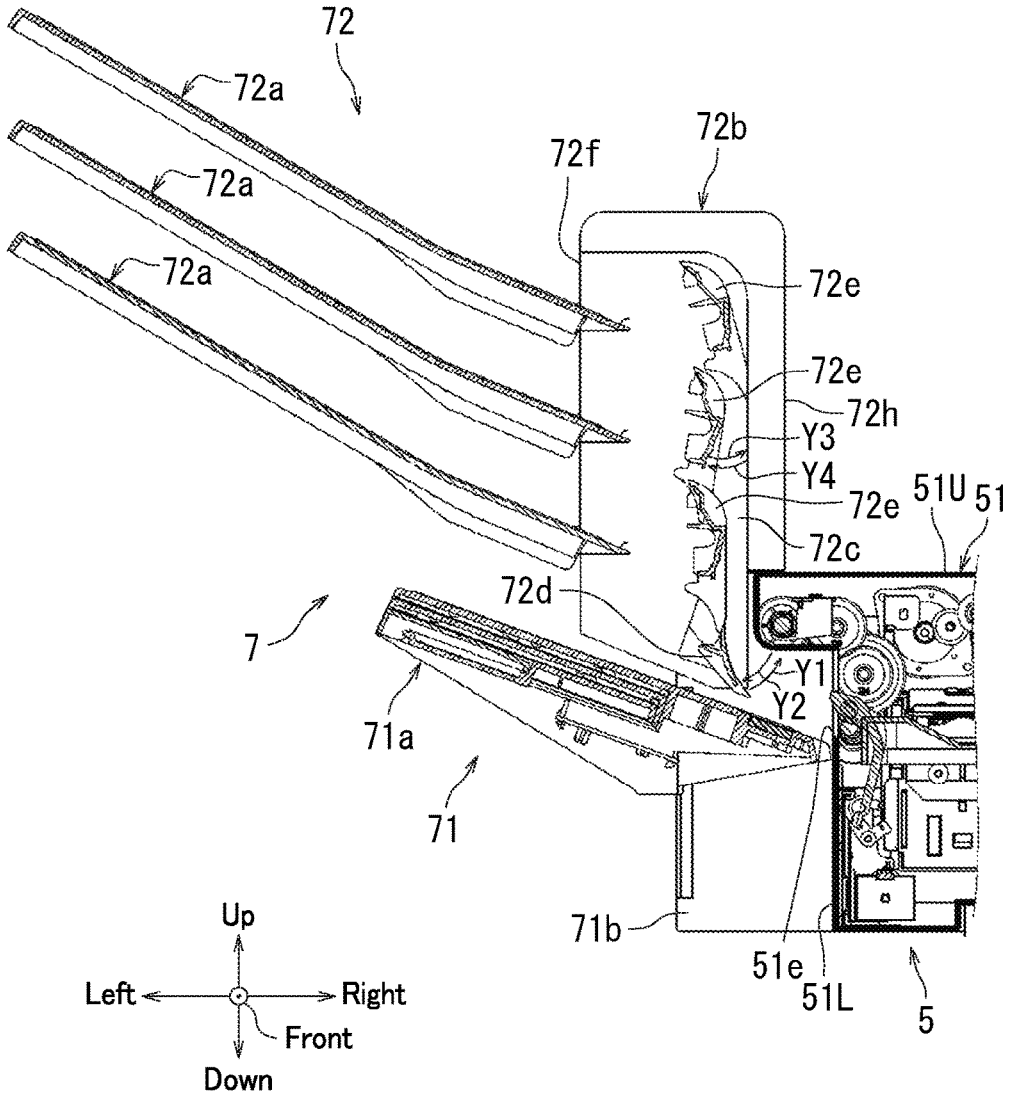
FIG. 6 is a cross-sectional view of the paper exit part.

The following describes the sorting tray unit 72 in detail with reference to FIG. 6. FIG. 6 is a cross-sectional view of the paper exit part 7.

As illustrated in FIG. 6, the sorting tray unit 72 further includes a conveyance path 72*c*, a main switch guide 72*d*, and a plurality of sub-switch guides 72*e* (switch guides). The conveyance path 72*c*, the main switch guide 72*d*, and the plurality of sub-switch guides 72*e* are located within the support 72*b*.

The support 72*b* has an open left side surface 72*f* and the plurality of sorting trays 72*a* are supported by the support 72*b* so as to project leftward from the support 72*b*.

The conveyance path 72*c* is a conveyance path along which paper conveyed into the support 72*b* is conveyed to any of the plurality of sorting trays 72*a*. The conveyance path 72*c* extends upward from a lower part of a right side surface 72*h* of the support 72*b*. The lower part of the right side surface 72*h* of the support 72*b* is open. The right side surface 72*h* extends upward from a left end of the upper surface 51U of the post-printing processing device 5.

The main switch guide 72*d* switches a route of conveyance of paper ejected from the post-printing processing device 5 to the movable paper exit tray 71*a* or to the conveyance path 72*c*. The main switch guide 72*d* is located in the vicinity of an entrance to the conveyance path 72*c*. The main switch guide 72*d* is pivotable in directions indicated by arrows Y1 and Y2. When the main switch guide

72*d* pivots in the direction indicated by the arrow Y1, paper ejected from the paper exit port 51*e* is ejected onto the movable paper exit tray 71*a*. When the main switch guide 72*d* pivots in the direction indicated by the arrow Y2, paper ejected from the post-printing processing device 5 is conveyed to the conveyance path 72*c*.

The plurality of sub-switch guides 72*e* sort paper ejected from the post-printing processing device 5 onto any of the plurality of sorting trays 72*a*. The plurality of sub-switch guides 72*e* each correspond to one of the plurality of sorting trays 72*a*. The plurality of sub-switch guides 72*e* are pivotable in directions indicated by arrows Y3 and Y4. When one of the plurality of sub-switch guides 72*e* pivots in the direction indicated by the arrow Y3 and the rest of the sub-switch guides 72*e* pivots in the direction indicated by the arrow Y4, paper moving upward along the conveyance path 72*c* is ejected by the one sub-switch guide 72*e* onto a corresponding one of the sorting trays 72*a*.

According to the image forming apparatus 1 described with reference to FIGS. 1 to 6, an increase in entire height of the image forming apparatus 1 is not involved even when a capacity of the paper exit part 7 thereof to which paper subjected to post-printing processing is ejected is increased.

That is, in a case where the S-shaped path system is employed for a paper conveyance path in an apparatus main body, a post-printing processing device located above the apparatus main body is usually mounted on the apparatus main body in such a posture that paper is ejected from the front of the post-printing processing device. In the above configuration, an opening to an in-body space may be blocked as a result of downward movement of a movable paper exit tray in use thereof. Therefore, it is necessary to restrict the downward movement of the movable paper exit tray so that the opening to the in-body space will not be blocked. Accordingly, a capacity of a paper exit part cannot be increased. Or, it is necessary to increase a height of the post-priming processing device in order to increase the capacity of the paper exit part. In other words, it is necessary to increase an entire height of the image forming apparatus.

By contrast, the paper exit part 7 can be located on the left side of the post-printing processing device 5 in the image forming apparatus 1 even in a configuration in which the S-shaped path system is employed for the paper conveyance path 27 in the main body 2. Accordingly, the opening to the in-body space 8 is not blocked as a result of downward movement of the movable paper exit tray 71*a*. Therefore, the capacity of the paper exit part 7 can be increased without involving an increase in entire height of the image forming apparatus 1.

Further, in a configuration in which a capacity of a paper exit part is increased by moving a movable paper exit tray upward, an entire height of an image forming apparatus increases further if a sorting tray unit is located above the movable paper exit tray. By contrast, the capacity of the paper exit part 7 of the image forming apparatus 1 can be increased by moving the movable paper exit tray 71*a* downward. Therefore, an increase in entire height of the image forming apparatus 1 is not involved even though the sorting tray unit 72 is located above the movable paper exit tray unit 71.

Further, the openable and closeable cover 21*b* is provided in the left side surface 21L of the main body 2 in order to take out the waste toner bottle 24, as illustrated in FIG. 1. Accordingly, a space sufficient for opening and closing the openable and closeable cover 21*b* should be left on the left side of the main body 2. As a result, there is a dead space on the left side of a conventional image forming apparatus. By contrast, such a dead space can be effectively used according to the image forming apparatus 1 in which the paper exit part 7 is located on the left side of the image firming apparatus 1.

Through the above, an embodiment of the present invention has been described with reference to the drawings (FIGS. 1 to 6). However, the present invention is not limited to the above embodiment and can be practiced in various manners within a scope not departing from the gist of the present invention (for example, as described below in (1) and (2)). The drawings schematically illustrate elements of configuration in order to facilitate understanding. Properties such as thickness and length, and the number of the elements of configuration illustrated in the drawings may differ from actual properties and the number thereof in order to facilitate preparation of the drawings. Also, materials, shapes, dimensions, and the like of elements of configuration described in the above embodiment are merely examples and not intended as specific limitations. Various alterations may be made within a scope not substantially departing from the effects of the present invention.

Figure 7:
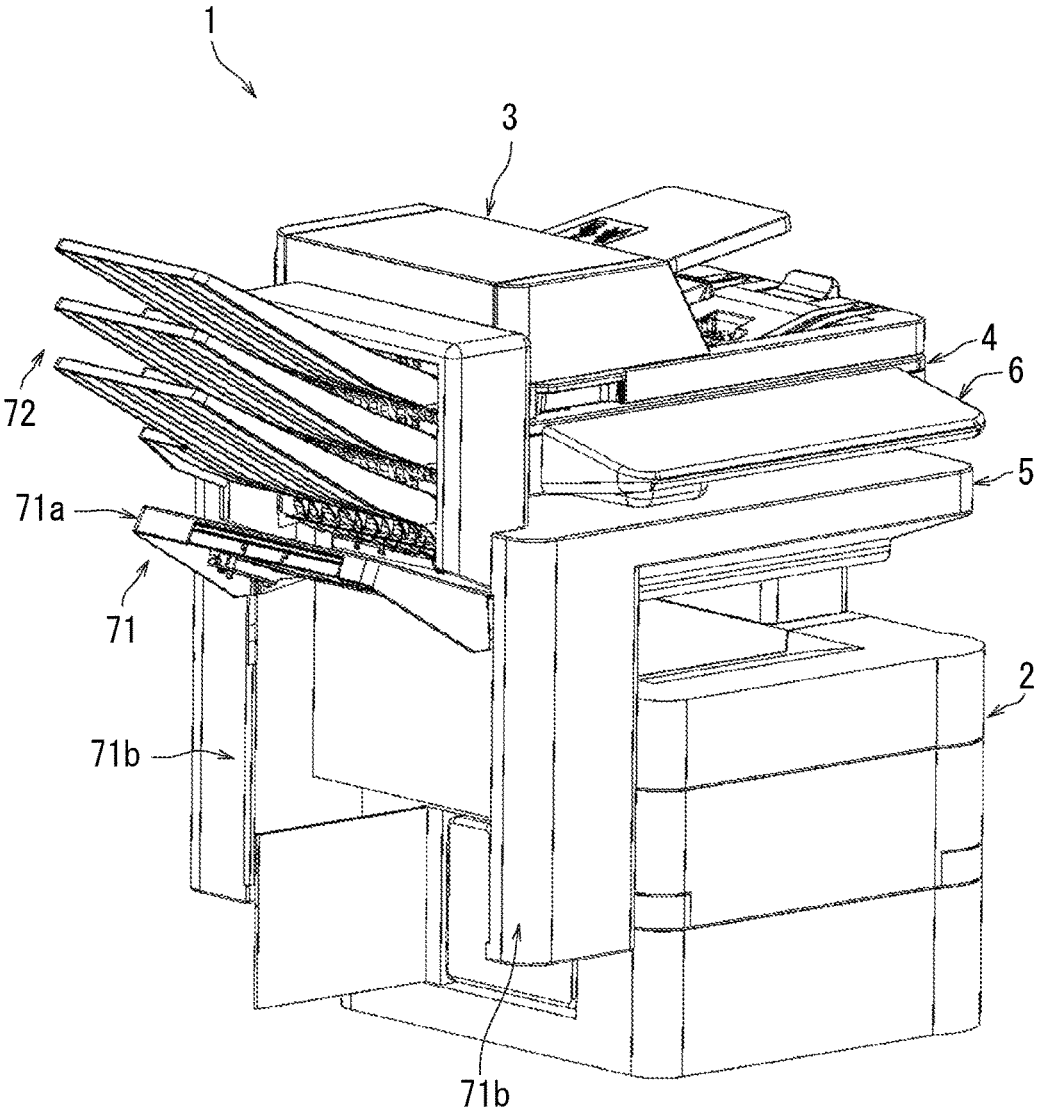
FIG. 7 is a perspective view of an image forming apparatus according to a first variation.

(1) The following describes a first variation of the present invention with reference to FIG. 7. FIG. 7 is a perspective view of an image forming apparatus 1 according to the first variation of the present invention.

The image forming apparatus 1 according to the present variation differs from the image forming apparatus 1 according to the embodiment described with reference to FIGS. 1 to 6 in that the movable paper exit tray 71*a* is movable downward to a lower part of the main body 2. Specifically, the paired supports 71*b* in the image forming apparatus 1 according to the present variation extend to the lower part of the main body 2. Therefore, the movable paper exit tray 71*a* is movable downward to the lower part of the main body 2. As a result, the capacity of the movable paper exit tray 71*a* can be further increased.

Figure 8:
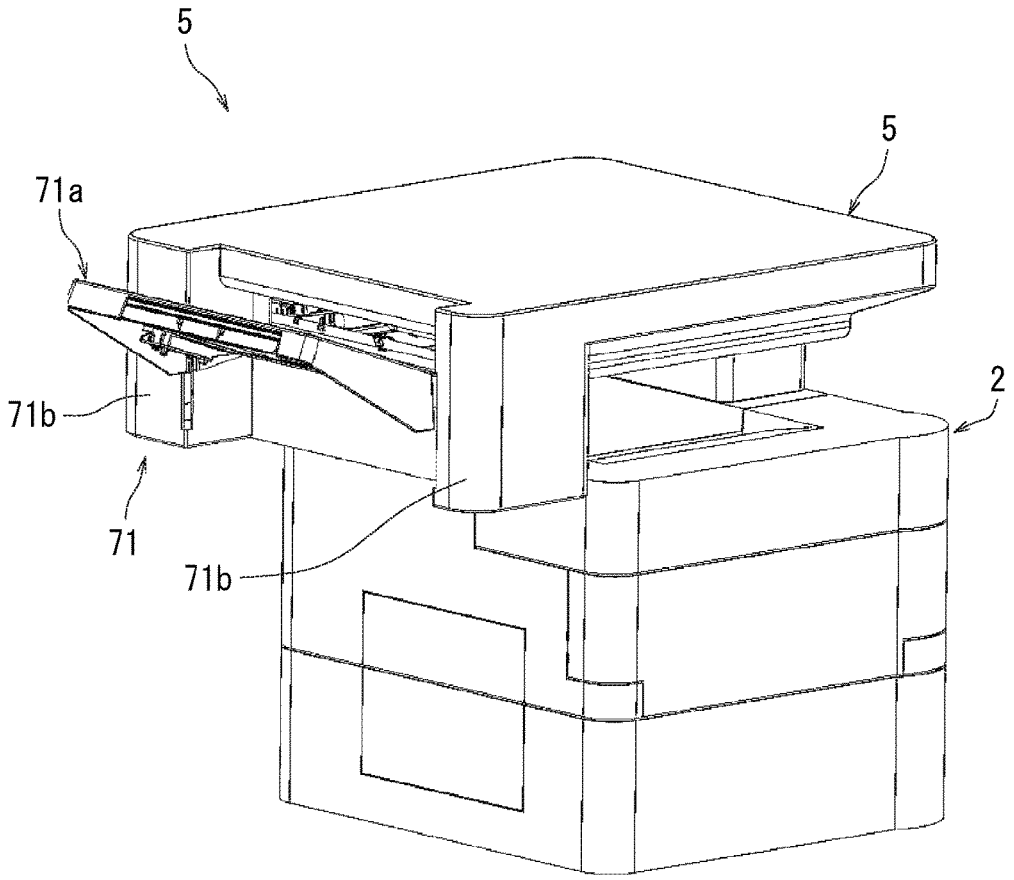
FIG. 8 is a perspective view of an image forming apparatus according to a second variation.

(2) The following describes a second variation of the present invention with reference to FIG. 8. FIG. 8 is a perspective view of an image forming apparatus 1 according to the second variation of the present invention.

The image forming apparatus 1 according to the present variation includes the main body 2, the post-printing processing device 5, and the movable paper exit tray unit 71. That is, the image forming apparatus 1 according to the present variation differs from the image forming apparatus 1 according to the embodiments described reference to FIGS. 1 to 7 in that the image forming apparatus 1 does not include the automatic document feeder 3, the image reading device 4, the operation panel 6, and the sorting tray unit 72. Therefore, an entire height of the image forming apparatus 1 according to the present variation can be lower than that of the image forming apparatus 1 according to the embodiments described with reference to FIGS. 1 to 7.

The invention claimed is:

1. An image forming apparatus comprising:

a main body configured to form an image on paper;

a post-printing processing device located above the main body and configured to perform post-printing processing on paper ejected from the main body; and a paper exit part that is located on a side surface of the post-printing processing device and to which paper is ejected, wherein the post-printing processing device includes:

a paper inlet port via which the paper ejected from the main body is conveyed; and a conveyance device that conveys the paper conveyed via the paper inlet port into the post-printing processing device to a first position in a forward direction of the post-printing processing device and conveys the paper from the first position in a transverse direction perpendicular to the forward direction to eject the paper to the paper exit part, the conveyance device includes:

paired movable guides that convey the paper in the transverse direction from the first position to a second position; and a conveyance roller that conveys the paper in the transverse direction from the second position to the paper exit part, and the paired movable guides are arranged such that the paper is interposed therebetween in the transverse direction.

2. The image forming apparatus according to claim 1, wherein the post-printing processing device includes:

a first conveyance path extending in the forward direction to the first position; and a second conveyance path extending in the transverse direction from the first position to the paper exit part.

3. The image forming apparatus according to claim 1, wherein the paper exit part includes:

a movable paper exit tray;

a support that supports the movable paper exit tray in a manner that the movable paper exit tray is movable in an up-down direction; and a driving mechanism that causes the movable paper exit tray to move upward or downward.

4. The image forming apparatus according to claim 3, wherein the support extends to a lower part of the main body, and the support supports the movable paper exit tray in a manner that the movable paper exit tray is movable downward to the lower part of the main body.

5. The image forming apparatus according to claim 3, wherein the paper exit part includes:

a plurality of sorting trays arranged in the up-down direction above the movable paper exit tray; and a switch guide that sorts paper ejected from the post-printing processing device onto any of the plurality of sorting trays.

6. The image forming apparatus according to claim 1, wherein the main body includes an openable and closeable cover, and the openable and closeable cover is located in a side surface of the main body and below the side surface of the post-printing processing device on which the paper exit part is located.

7. The image forming apparatus according to claim 1, wherein the paired movable guides include:

a first movable guide located beside the paper exit part in the transverse direction; and a second movable guide located opposite to the first movable guide, the post-printing processing device further includes a guide plate, the guide plate has an upper edge sloping downward in a direction from the second position toward the first position, the first movable guide has a slit, and when the paired movable guides convey the paper to the second position, the guide plate is inserted into the slit and an end of the paper close to the paper exit part moves upward along the upper edge of the guide plate and reaches an upper end of the second movable guide.

8. An image forming apparatus comprising:

a main body configured to form an image on paper;

a post-printing processing device located above the main body and configured to perform post-printing processing on paper ejected from the main body; and a paper exit part that is located on a side surface of the post-printing processing device and to which paper is ejected, wherein the post-printing processing device includes:

a paper inlet port via which the paper ejected from the main body is conveyed; and a conveyance device that conveys the paper conveyed via the paper inlet port into the post-printing processing device to a first position in a forward direction of the post-printing processing device and conveys the paper from the first position in a transverse direction perpendicular to the forward direction to eject the paper to the paper exit part, the paper exit part includes:

a movable paper exit tray;

a support that supports the movable paper exit tray in a manner that the movable paper exit tray is movable in an up-down direction; and a driving mechanism that causes the movable paper exit tray to move upward or downward, the support extends to a lower part of the main body, and the support supports the movable paper exit tray in a manner that the movable paper exit tray is movable downward to the lower part of the main body.

* * * * *